US009875732B2

(12) United States Patent
Suitor

(10) Patent No.: US 9,875,732 B2
(45) Date of Patent: Jan. 23, 2018

(54) HANDHELD ELECTRONIC MUSICAL PERCUSSION INSTRUMENT

(71) Applicant: Stephen Suitor, Radcliff, KY (US)

(72) Inventor: Stephen Suitor, Radcliff, KY (US)

( * ) Notice: Subject to any disclaimer, the term of this patent is extended or adjusted under 35 U.S.C. 154(b) by 0 days.

(21) Appl. No.: 15/456,471

(22) Filed: Mar. 10, 2017

(65) Prior Publication Data

US 2017/0270904 A1 Sep. 21, 2017

Related U.S. Application Data

(63) Continuation-in-part of application No. 15/433,990, filed on Feb. 15, 2017, which is a continuation-in-part of application No. 14/988,570, filed on Jan. 5, 2016, now Pat. No. 9,761,212.

(60) Provisional application No. 62/306,306, filed on Mar. 10, 2016, provisional application No. 62/295,483, filed on Feb. 15, 2016, provisional application No. 62/259,047, filed on Nov. 23, 2015, provisional application No. 62/100,041, filed on Jan. 5, 2015, provisional application No. 62/448,388, filed on Jan. 19, 2017, provisional application No. 62/448,953, filed on Jan. 20, 2017.

(51) Int. Cl.
*G10H 3/14* (2006.01)
*G10H 1/00* (2006.01)

(52) U.S. Cl.
CPC ..... *G10H 3/143* (2013.01); *G10H 1/0008* (2013.01); *G10H 1/0083* (2013.01); *G10H 3/146* (2013.01); *G10H 2220/026* (2013.01); *G10H 2220/395* (2013.01); *G10H 2220/525* (2013.01); *G10H 2230/035* (2013.01); *G10H 2230/365* (2013.01); *G10H 2240/161* (2013.01); *G10H 2250/055* (2013.01)

(58) Field of Classification Search
None
See application file for complete search history.

(56) References Cited

U.S. PATENT DOCUMENTS

| | | | |
|---|---|---|---|
| 1,176,943 | A | 9/1913 | Bollinger |
| 2,655,071 | A | 10/1953 | Levay |
| 2,666,848 | A | 1/1954 | Goodwin |
| 2,808,522 | A | 10/1957 | Dranetz |

(Continued)

FOREIGN PATENT DOCUMENTS

| | | |
|---|---|---|
| EP | 0264782 | 4/1988 |
| EP | 2437253 | 4/2012 |

(Continued)

*Primary Examiner* — Marlon Fletcher
(74) *Attorney, Agent, or Firm* — Duncan Galloway Egan Greenwald, PLLC; Kevin T. Duncan

(57) ABSTRACT

An apparatus, system, and method for an electronic handheld musical instrument that generates electronic signals for processing by a processor-based module to generate musical sounds adapted to replicate non-electronic traditional hand percussion and other handheld instruments, is provided. A piezoelectric-based trigger is secured in an enclosed volume or enclosure formed in the electronic handheld musical instrument. When manipulated by a musician in a normal fashion, freely moving beads float or travel within the enclosure of the electronic handheld musical instrument and strike against a sensitive face of the piezoelectric transducer device to create a desired sound effect.

20 Claims, 11 Drawing Sheets

MAIN DIGITAL SHAKER ASSEMBLY

(56) References Cited

U.S. PATENT DOCUMENTS 3,053,949 A 9/1962 Johnson
3,170,076 A 2/1965 Thomas
3,198,872 A 8/1965 Finkenbeiner
3,375,747 A 4/1968 Posey
3,439,568 A 4/1969 Griffith
3,453,920 A 7/1969 Scherer
3,509,264 A 4/1970 Green
3,510,566 A 5/1970 McKenzie
3,553,339 A 1/1971 Dominguez et al.
3,634,595 A 1/1972 Pasquali
3,659,032 A 4/1972 May
3,665,490 A 5/1972 Oskar
3,677,126 A 7/1972 Pierce
3,680,423 A 8/1972 Lander
3,725,561 A 4/1973 Paul
3,731,022 A 5/1973 Loftus
3,733,425 A 5/1973 Chaki
3,748,367 A 7/1973 Lamme et al.
3,956,958 A 5/1976 Nash et al.
3,956,959 A 5/1976 Ebihara
4,030,396 A 6/1977 Mariner
4,141,273 A 2/1979 Austin
4,168,646 A 9/1979 May
4,178,823 A 12/1979 McCoskey
4,189,969 A 2/1980 Katayama et al.
4,200,025 A 4/1980 Currier
4,201,107 A 5/1980 Barber, Jr.
4,226,156 A 10/1980 Hyakutake
4,227,049 A 10/1980 Thomson et al.
4,242,937 A 1/1981 Pozar
4,245,539 A 1/1981 Jones
4,279,188 A 7/1981 Scott
4,290,331 A 9/1981 Izdebski
4,341,140 A 7/1982 Ishida
4,368,400 A 1/1983 Taniguchi et al.
4,371,804 A 2/1983 Peng et al.
4,378,721 A 4/1983 Kaneko et al.
4,415,181 A 11/1983 Hartry et al.
4,418,598 A 12/1983 Ulynas
4,479,412 A 10/1984 Klynas
4,491,050 A 1/1985 Franzmann
4,562,740 A 1/1986 Webber et al.
4,567,805 A 2/1986 Clevinger
4,570,522 A 2/1986 May
4,581,972 A 4/1986 Hoshino
4,581,973 A 4/1986 Hoshino
4,630,465 A 12/1986 Hatton
4,648,302 A 3/1987 Bozzio
4,657,114 A 4/1987 Shaw
4,660,410 A 4/1987 Asano et al.
4,669,349 A 6/1987 Hyakutake
4,672,839 A 6/1987 Takeuchi et al.
4,700,602 A 10/1987 Bozzio
4,737,676 A 4/1988 Engel et al.
4,744,279 A 5/1988 Livingston
4,750,397 A 6/1988 Ashworth-Jones
4,753,146 A 6/1988 Seiler
4,776,253 A 10/1988 Downes
4,809,337 A 2/1989 Scholz et al.
4,817,485 A 4/1989 Bozzio et al.
4,819,536 A 4/1989 Lombardi
4,837,836 A 6/1989 Barcus
4,860,625 A 8/1989 Mathews
4,867,027 A 9/1989 Barbera
4,867,028 A 9/1989 Jones
4,899,633 A 2/1990 Lombardi
4,904,222 A * 2/1990 Gastgeb ..... A63H 5/00 310/331
4,909,117 A 3/1990 Reiling et al.
4,947,725 A 8/1990 Nomura
4,984,498 A 1/1991 Fishman
4,995,294 A * 2/1991 Kashio ..... G10H 1/34 200/61.48
5,001,959 A 3/1991 Kimpara
5,042,356 A 8/1991 Karch
5,056,403 A 10/1991 Yamashita
5,063,821 A 11/1991 Battle
5,085,119 A 2/1992 Cole
D324,687 S 3/1992 Olson
5,095,799 A 3/1992 Wallace et al.
5,105,710 A 4/1992 Rothmel
5,105,711 A 4/1992 Barnard
5,115,706 A 5/1992 Aluisi
5,121,668 A 6/1992 Segan
5,123,325 A 6/1992 Turner
5,134,920 A 8/1992 Clark
5,140,887 A 8/1992 Chapman
5,157,213 A * 10/1992 Kashio ..... G10H 1/34 84/622
5,204,487 A 4/1993 Turner
5,223,658 A 6/1993 Suzuki
5,235,891 A 8/1993 Klein
5,293,000 A 3/1994 Adinolfi
5,322,969 A 6/1994 Aaroe et al.
5,345,037 A 9/1994 Nordelius
5,350,881 A * 9/1994 Kashio ..... G10H 1/34 84/622
5,371,830 A 12/1994 Wachenheim
5,403,972 A 4/1995 Valentine, Sr.
5,430,245 A 7/1995 Rogers
5,455,381 A 10/1995 Juszkiewicz et al.
5,463,185 A 10/1995 Fishman
5,499,541 A 3/1996 Hopf et al.
5,550,321 A 8/1996 Brann
5,583,307 A 12/1996 Tobia, Jr.
5,602,353 A 2/1997 Juszkiewicz et al.
5,602,354 A 2/1997 Martin
5,614,688 A 3/1997 Donnell
5,627,336 A 5/1997 Stevens
5,796,025 A 8/1998 Haake
5,811,709 A 9/1998 Adinolfi
5,817,966 A 10/1998 Fishman
5,866,829 A 2/1999 Pecoraro
5,866,836 A 2/1999 Bergstrom
5,878,359 A 3/1999 Takeda
5,900,573 A 5/1999 Barnes
5,977,473 A 11/1999 Adinolfi
6,031,176 A 2/2000 Tanaka
6,075,198 A 6/2000 Grant et al.
6,094,490 A 7/2000 Kim
6,121,528 A 9/2000 May
6,166,307 A 12/2000 Caulkins et al.
6,198,034 B1 * 3/2001 Beach ..... G10H 1/0083 84/407
6,215,055 B1 4/2001 Saravis
6,369,308 B1 4/2002 Orr
6,441,293 B1 8/2002 LaBarbera
6,794,569 B2 9/2004 Kamijima et al.
D497,935 S 11/2004 Kamijima et al.
6,979,770 B2 12/2005 Hampton, Jr.
6,982,376 B2 1/2006 Wise
7,015,391 B2 3/2006 Tomoda
7,038,117 B2 5/2006 Yoshino
7,115,805 B1 10/2006 Vandervoort
7,179,985 B2 2/2007 Pickens
7,259,317 B2 8/2007 Hsien
7,282,633 B1 10/2007 Coolidge
7,396,991 B2 7/2008 Susami
7,470,847 B2 12/2008 Kitagawa
7,488,887 B2 2/2009 Mori
7,525,032 B2 4/2009 Mishima
7,608,776 B2 10/2009 Ludwig
7,667,130 B2 2/2010 Mishima
7,723,592 B1 5/2010 Dixson
7,754,956 B2 7/2010 Gain et al.
8,039,724 B1 10/2011 Normam et al.
8,121,300 B1 2/2012 LoDuca et al.
8,173,886 B2 5/2012 Hashimoto
8,178,768 B1 5/2012 Shepherd
8,258,392 B2 9/2012 Mori
8,354,581 B2 1/2013 Eventoff et al.
8,373,052 B2 2/2013 Yoshino
8,461,446 B1 6/2013 Gibson
8,546,676 B2 10/2013 Hashimoto

(56) References Cited

U.S. PATENT DOCUMENTS

| | | | | |
|---|---|---|---|---|
| 8,563,843 | B1 | 10/2013 | Shemesh | |
| 8,884,151 | B1 | 11/2014 | Lee | |
| 2002/0056357 | A1 | 5/2002 | Kassabian | |
| 2002/0152872 | A1 | 10/2002 | O'Donnell | |
| 2003/0004603 | A1 | 1/2003 | Hagemeister et al. | |
| 2003/0131721 | A1 | 7/2003 | Minakuchi et al. | |
| 2004/0020348 | A1* | 2/2004 | Ishida | G10H 1/0058 84/609 |
| 2004/0025663 | A1 | 2/2004 | Harada et al. | |
| 2004/0149120 | A1 | 8/2004 | Maruhashi et al. | |
| 2004/0211310 | A1 | 10/2004 | Hagiwara | |
| 2005/0016367 | A1 | 1/2005 | Hasenmaier | |
| 2005/0022655 | A1 | 2/2005 | Wise | |
| 2005/0150366 | A1 | 7/2005 | Susami | |
| 2006/0000341 | A1 | 1/2006 | Steele | |
| 2006/0021495 | A1 | 2/2006 | Freitas | |
| 2006/0219092 | A1 | 10/2006 | Mishima | |
| 2007/0107587 | A1 | 5/2007 | Lee | |
| 2007/0234888 | A1 | 10/2007 | de Moraes | |
| 2008/0034946 | A1 | 2/2008 | Aimi | |
| 2008/0071958 | A1 | 3/2008 | Honda et al. | |
| 2009/0000464 | A1 | 1/2009 | Mishima | |
| 2010/0031800 | A1 | 2/2010 | Van Ekstrom | |
| 2012/0073425 | A1 | 3/2012 | Hashimoto | |
| 2012/0180621 | A1 | 7/2012 | Hall | |
| 2013/0098227 | A1 | 4/2013 | Wei | |
| 2013/0112068 | A1 | 5/2013 | Rogers | |
| 2013/0333545 | A1 | 12/2013 | Dunwoodie | |
| 2014/0000445 | A1 | 1/2014 | Gulak | |
| 2015/0009417 | A1 | 1/2015 | Jargiello, III | |
| 2015/0068392 | A1 | 3/2015 | Huston et al. | |
| 2016/0210941 | A1 | 7/2016 | Suitor | |

FOREIGN PATENT DOCUMENTS

| | | |
|---|---|---|
| GB | 2183076 | 6/1986 |
| WO | 1990/003639 | 4/1990 |

* cited by examiner

ADDITIONAL FEATURES

SILICON SLEEVES /GURIO SCRAPER/VARIETY OF STICKS AND BRUSHES

HANDHELD ELECTRONIC MUSICAL PERCUSSION INSTRUMENT

CROSS REFERENCE TO RELATED APPLICATIONS

The present application claims benefit of U.S. Provisional Patent Application 62/306,306, entitled HANDHELD ELECTRONIC MUSICAL PERCUSSION INSTRUMENT (Suitor), filed Mar. 10, 2016; the present application claims benefit of priority and is a continuation-in-part of pending U.S. patent application Ser. No. 15/433,990, entitled MAGNETICALLY SECURED CYMBAL TRIGGER AND CHOKE ASSEMBLY (Suitor), filed Feb. 15, 2017, which claims priority to U.S. Provisional Patent Application 62/295,483, entitled MAGNETICALLY SECURED CYMBAL TRIGGER AND CHOKE ASSEMBLY (Suitor), filed Feb. 15, 2016; the present application claims benefit of priority and is a continuation-in-part of pending U.S. Utility patent application Ser. No. 14/988,570, entitled MAGNETICALLY SECURED INSTRUMENT TRIGGER (Suitor), filed Jan. 5, 2016, (the "'570 application"), which claims priority to U.S. Provisional Patent Application 62/259,047, entitled PIEZOELECTRIC INSTRUMENT TRIGGER (Suitor), filed Nov. 23, 2015, which also claims priority to U.S. Provisional Patent Application 62/100,041, entitled DUAL SIDED MAGNETIC DRUM TRIGGER (Suitor), filed Jan. 5, 2015; the present application claims benefit of U.S. Provisional Patent Application 62/448,388, entitled MAGNETICALLY SECURED INSTRUMENT TRIGGER AND INSTRUMENT TRIGGER MOUNTING SYSTEMS AND METHODS (Suitor), filed Jan. 19, 2017; the present application claims benefit of U.S. Provisional Patent Application 62/448,953, entitled MAGNETICALLY SECURED INSTRUMENT TRIGGER AND INSTRUMENT TRIGGER MOUNTING SYSTEMS AND METHODS (Suitor), filed Jan. 20, 2017; each of which is incorporated by reference in their entirety.

FIELD OF THE INVENTION

The field of the invention is musical instruments and in particular to handheld musical instruments and to electronic musical instruments.

BACKGROUND

There exist a variety of non-electric musical instruments that may be used in a performance to create certain desired sounds by musicians manipulating such instruments. The following is a link to a Wikipedia webpage that is incorporated herein by reference that describes a variety of known hand percussion instruments: (https://en.wikipedia.org/wiki/Hand_percussion). As stated at this webpage, "Hand percussion is a term used to indicate a percussion instrument of any type from any culture that is held in the hand. They can be made from wood, metal or plastic and are usually either shaken, scraped or tapped with fingers or a stick. It is a useful category in terms of a large percussion orchestra in that it identifies all instruments that are not drums or pitched percussion such as marimba and xylophone." The article further states "A shaker (percussion) is any instrument that makes a noise when shaken. Historically they were naturally occurring items such as seed pods. A caxixi is a basketwork shaker with a gourd base. Gourds are used all over the world and covered with a net with shells or seeds to create an instrument such as the shekere. Modern shakers are often cylinders made from metal wood or plastic containing small hard items such as seeds, stones, or plastic—an example is the Egg Shaker. There is another category of shaken instrument using jingles, little discs of metal which tap together when shaken. Tambourines fall into this category." In addition, scrapers are a type of instrument that may be "a wood, metal or plastic instrument which has ridges on its body. Often known as Guiro, rhythms are created by running a thin stick up and down the ridges at different speeds. Gourds or bamboo have traditionally been used as they have a resonant hollow body and can easily be cut with ridges. A common type from Asia is a carved wooden frog which has ridges cut on its back and its mouth and belly hollowed out." In addition there are devices that may be struck together or with a stich or mallet or by hand to create sounds, e.g., triangle, cow bell, tapping or clapping sticks, tamborim and tambourine.

One problem is that the purely mechanical sound generated by such devices are hard to capture for recording or amplification. While microphones and the like are useful in recording and capturing generated sound for amplification, such devices are separate from the instrument itself and present difficulties in sampling and mixing the sounds with sounds generated by other instruments used by other musicians. Such difficulties are particular problematic in the context of live performances.

The '570 application incorporated herein by reference discloses a novel drum trigger device that includes a piezoelectric triggering component that transduces the mechanical energy associated with a drum strike into an electronic signal. The electronic signal is then delivered to a module designed to process the received electronic signal into a sound associated with the particular instrument associated with the particular trigger generating the signal, e.g., snare drum, tom drum, kick drum, or cymbal/hi-hat.

The function and operation of piezoelectric transducers and the piezoelectric effect is well known in the art. A description of the functioning of a piezoelectric transducer can be found in the article *Piezoelectric Transducers*, NDT Resource Center, https://www.nde-ed.org/EducationResources/CommunityCollege/Ultrasonics/EquipmentTrans/piezotransducers.htm, accessed Jan. 5, 2016, which is incorporated by reference herein in its entirety. Additional information on piezoelectric transducers can be found in the article *What's a Transducer*?, APC International, LTD, https://www.americanpiezo.com/piezo-theory/whats-a-transducer.html, accessed Jan. 5, 2016, which is incorporated by reference herein in its entirety. Detail on the mechanics and function of piezoelectric transducers can be found in the article *Introduction to Piezo Transducers*, Piezo Systems, Inc., http://www.piezo.com/tech2intropiezotrans.html, accessed Jan. 5, 2016, which is incorporated by reference herein in its entirety.

All extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is a need for electronic handheld percussion instruments capable of generating electronic signals for processing by a processor-based module to generate musical sounds adapted to replicate non-electronic traditional hand percussion and other handheld instruments.

SUMMARY OF THE INVENTION

The present invention provides apparatus, systems, and methods in which a piezoelectric-based trigger is secured in an enclosed volume or enclosure formed in a handheld instrument. The enclosure houses a plurality of beads, e.g., plastic or metal beads, designed to float or travel relatively freely within the confined space. The enclosure formed in handheld musical instrument is designed to allow the enclosed beads to strike against a sensitive face of the piezoelectric transducer device ("trigger device") when the handheld musical instrument is manipulated in a normal fashion by a musician, e.g., shaking the device to and fro, back and forth, or rolling or in whatever manner to create a desired sound effect.

In some embodiments, the piezoelectric transducer transduces or translates the striking of the beads when played, handled, or shaken into a digital or analog electrical signal. In some embodiments, the sound-receiving element or striking surface of the piezoelectric trigger device may be protected by a silicone buffer layer or other protective material. The piezoelectric transducer is electrically coupled to an analog or digital sound management system. In some embodiments, the digital sound management system is a sound module, and the piezoelectric transducer is connected to the sound module via a TRS jack. The sound module may be a MIDI (Musical Instrument Digital Interface)-based interface well known in the art. Wikipedia has webpages, which are incorporated herein by reference, with information concerning MIDI devices and protocol—https://en.wikipedia.org/wiki/Midi; https://en.wikipedia.org/wiki/MIDI.

While a piezoelectric device is referenced herein as the sound-receiving element and transducing component, this specific reference is for ease in describing the invention and is not be way of limiting the invention to such devices. One of ordinary skill in the art would appreciate that other suitable devices adapted to interpret the striking of beads or other free-floating elements against a surface to generate an electronic signal capable of being received and processed by a module into a desired sound falls within the use and scope of the invention.

The piezoelectric trigger-based handheld instrument of the present invention provides a whole new category of instrument and opens the door to numerous applications for such instruments.

One advantage that many non-electric instruments have had over electric instruments is the free movement of the performer when the instrument being played is not tethered by way of an electric cord to a sound producing module. However, wireless modules and transmitters are available today to obviate such an advantage. In the case of the present invention, a small wireless transmitter is preferably included to allow the musician to move freely during a performance or otherwise playing the handheld instrument.

The trigger of the present invention is triggered when being struck by beads entrapped within the enclosure and may be triggered based on sensing an external striking of the housing, e.g., a stick strike on the outside surface of the instrument. In addition, a series of ribs or raised protuberances may be formed on the outside surface of the instrument so that a musician may cause a series of staccato strikes when gliding the striking device, e.g., stick, along and over the series of ribs or ridges. The piezoelectric device is sensitive to the variations in the strikes caused in this manner on the housing.

Because the output generated by the piezoelectric trigger is processed, for example, by a MIDI sound module, the invention may be further configured to allow a user to select, e.g., a selector switch appearing on the instrument or on the module or intermediate the trigger and module, a particular type instrument, sound or effect desired. In addition, the instrument may include a plurality of piezoelectric transducers with a plurality of inputs into the MIDI sound module. Such triggers may be disposed in separate enclosures or locations on the instrument and may be triggered by operation of different active elements and materials, e.g., beads, ball, sand, etc. In fact, the invention opens the door to uses never before applied and may be used in a user configurable instrument. For example, the enclosure(s) having the trigger device may have an opening for allowing a user to insert whatever elements or materials desired to create whole new sound effects.

For example, the musical instrument may be configured in an advantageous way to provide a reduced, easily transportable e-drum kit and may be optimized in one manner to sit upon a user's lap while being played. The instrument may have multiple zones each having a piezoelectric transducer associated with it and optionally means to isolate vibrations from one zone to other zones. Zones may be struck by hand, stick, foot, or other means to cause a vibration for detection by an associated piezoelectric trigger. Zones related to drums, e.g., snare, tom, kick, may be round to give the look of a drum head. Additional zones or locations or extensions may be used to generate sounds related to cymbals, hi-hats, gongs, etc. In this manner the invention may be used to create an instrument configuration capable of being a "one-man band" set up with multiple inputs (wired or wireless) to MIDI modules, drum modules (such as produced by Yamaha, Roland and other e-drum module manufacturers).

The electronic handheld musical instrument may also comprise an accelerometer module comprising an accelerometer that is adapted to measure movement of the electronic handheld musical instrument along X, Y, and Z axes and output the measured movement as a movement signal. A sound bank microchip may be present on the electronic handheld musical instrument which is adapted to receive the movement signal from the accelerometer and store the movement signal in a memory. This is advantageous, as it is opposed to a sound bank microchip simply acting as a wireless tool for transmitting triggering information to a module that then stores the audio separately. Further, a radio frequency wireless transmitter may be present on the electronic handheld musical instrument, which is adapted to transmit the stored movement signal and the trigger signal, which is generated based on detected vibration from the set of freely movable elements disposed within the handheld musical instrument coming into contact with a surface of the set of trigger devices, to a separate module. The generated signals are based on the movement signal and the trigger signal. A Bluetooth module may be implemented, which is adapted to receive a set of configuration information, potentially from a mobile device through the use of a mobile application, for the electronic handheld musical instrument. Moreover, the configuration information defines a set of operating parameters for the electronic handheld musical instrument. The Bluetooth module may be an HC-05 type. Wikipedia has webpages, which are incorporated herein by reference, with information concerning HC-05 type Bluetooth chips or modules https://www.itead.cc/wiki/Serial Port Bluetooth Module (Master/Slave)_:_HC-05, https://wiki.eprolabs.com/index.php?title=Bluetooth Module HC-05 and are sold at numerous sites such as https://www.itead.cc/wiki/Serial Port Bluetooth Module (Master/Slave)_:_HC-05 or https://www.alibaba.com/product-detail/Bluetooth-wireless-module-HC-05_60580804877.html?s=p.

Further, the accelerometer module may include a power source, in this case battery which may be regulated by a voltage regulator. Additionally, a microcontroller may be included as an embedded controller adapted to at least facilitate the transmission of the movement signal and the trigger signal.

In a first embodiment, the present invention provides an electronic handheld musical instrument comprising: a housing having a first enclosed space; a trigger device disposed at least in part in the first enclosed space; a set of freely movable elements contained within the first enclosed space and adapted to come into contact with a surface of the trigger device thereby causing the trigger device to generate a trigger signal based on a detected vibration; wherein the trigger signal is transmitted to a separate module, the separate module adapted to generate output signals based on the trigger signal; and wherein the output signals represent one of a sound output, desired sound effect, lighting effect, audio output, or switching signal.

The first embodiment may be further characterized as: wherein the trigger device may be a piezoelectric transducer; the electronic handheld musical instrument may further comprise: a wireless device for wirelessly transmitting the trigger signal; an on-off switch for selectively transitioning the handheld musical instrument from an active and inactive state and for allowing the flow of electrical current and the generation of trigger signal; and indicators for indicating the status of the device including a mode of operation; wherein the set of freely movable elements may comprise a set of plastic beads, a set of metal beads, a ball, or a set of granular material, e.g., sand; the instrument may comprise a drum module; wherein the housing may further comprise a movable portion adapted to provide access to the interior of the first enclosed space for placing or removing the set of freely movable elements; wherein the housing may further comprise a second enclosed space and a second trigger device; the electronic handheld musical instrument may further comprise one or more of a sensitivity element for user selection of sensitivity setting, a battery power source, and a battery level indicator; wherein the housing may further comprise a battery enclosure space for receiving the battery power source; wherein the housing may further comprise a wireless device enclosed space for receiving a wireless transmitting device; the electronic handheld musical instrument may further comprise a channel selector switch adapted to selectively place the handheld musical instrument in operation over a given channel or frequency; the electronic handheld musical instrument may further comprise an audio mixer; an antenna for transmitting the trigger signal; a band pass filter section; a signal detector; a local oscillator; an XLR audio output; and a ¼ inch unbalanced audio output; the electronic handheld musical instrument wherein the separate module may further comprise an FM long range receiver for receiving the wirelessly transmitted trigger signal, and wherein the separate module may be further adapted to generate an intermediate signal for delivery to a sound module; the electronic handheld musical instrument may further comprise an amplifier for amplifying a sound associated with the trigger signal; the electronic handheld musical instrument may further comprise: an opening adapted to provide access to the first enclosed space, the opening further adapted to receive an object for striking against the surface of the trigger device; and an opening cover, the opening cover may be a hatch, door, plug, rubber seal, adapted to close the first enclosed space; the electronic handheld musical instrument may further comprise: an accelerometer adapted to measure movement of the electronic handheld musical instrument along X, Y, and Z axes and output the measured movement as a movement signal; a sound bank microchip adapted to receive the movement signal from the accelerometer and store the movement signal in a memory; a radio frequency wireless transmitter adapted to transmit the stored movement signal and the trigger signal to the separate module; and wherein the generated signals are based on the movement signal and the trigger signal; the electronic handheld musical instrument may further comprise a Bluetooth module adapted to receive a set of configuration information for the electronic handheld musical instrument, the set of configuration information having been transmitted by a mobile device, and the configuration information defining a set of operating parameters for the electronic handheld musical instrument.

In another embodiment, the present invention provides a method for generating electronic signals from an electronic handheld musical instrument for processing by a module to produce sounds adapted to replicate non-electronic traditional handheld instruments, the method comprising: actuating a set trigger devices disposed within the electronic handheld musical instrument by manipulating the electronic handheld musical instrument, the manipulation causing a set of freely movable elements disposed within the handheld musical instrument to come into contact with a surface of the set of trigger devices thereby causing the set of trigger devices to generate a trigger signal based on a detected vibration; transmitting the trigger signal to a separate module; and generating, by the separate module, a set of output signals based on the trigger signal, the set of output signals representing a sound output or desired sound effect or other action.

The method embodiment may be further characterized as: wherein the set of trigger devices may comprise a set of piezoelectric transducers, and wherein the movable elements may comprise a set of plastic beads, a set of metal beads, a ball, or a set of granular material; the method may further comprise: measuring by an accelerometer movement of the electronic handheld musical instrument along X, Y, and Z axes; outputting by the accelerometer the measured movement as a movement signal; receiving and storing by a sound bank microchip the movement signal from the accelerometer; and transmitting by a radio frequency wireless transmitter the stored movement signal and the trigger signal to the separate module, and wherein the generated signals are based on the movement signal and the trigger signal; the method may further comprise amplifying a sound associated with the trigger signal via an amplifier disposed within the electronic handheld musical instrument.

In yet another embodiment the present invention provides a self-contained e-drum kit comprising a housing delineated by a set of discrete zones, each discrete zone having at least one trigger device adapted to sense vibrations caused when the zone is struck by an object, each trigger adapted to generate a trigger signal and having an output for outputting the trigger signal, and a means for electrically communicating the trigger signal to a sound processing module.

A further embodiment of the present invention is a user-adaptable handheld instrument having a first enclosed space with a first piezoelectric device enclosed at least in part therein and an opening provided for allowing a user to open the first enclosed space, place therein an object for striking against a surface of the piezoelectric device, and closing the first enclosed space.

BRIEF DESCRIPTION OF THE DRAWING

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Figures 1A, 1B:
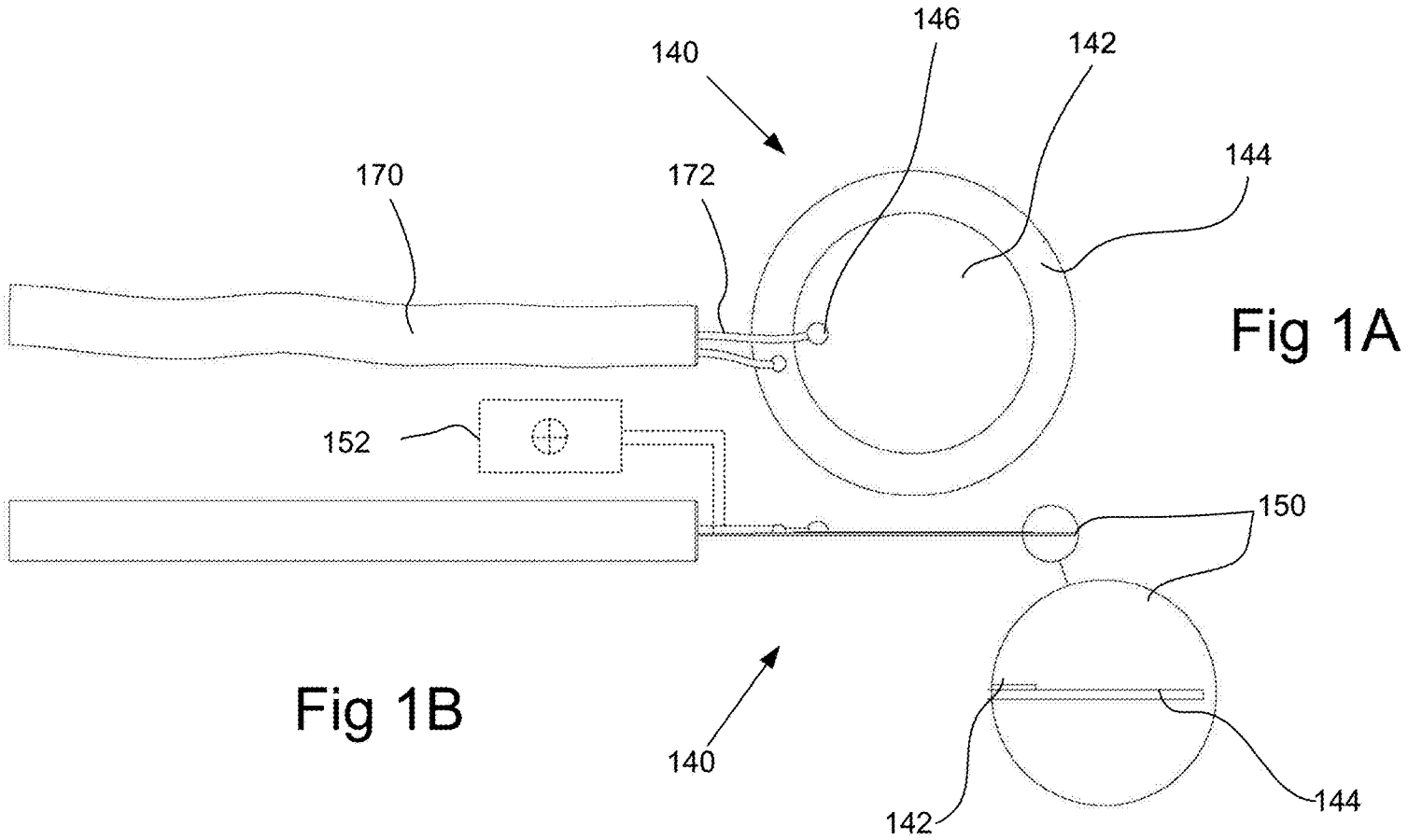
FIGS. 1A and 1B provide plan and side views respectively of a trigger device in the form of a piezoelectric transducer according to the present invention.

With reference to FIGS. 1A and 1B, plan and side views respectively of a piezoelectric transducer 140 according to the present invention are provided. In FIG. 15A, the electrical lead 170 with set of wires 172 is shown electrically and operatively connected to electrical connections 146 on the bottom portion 144 and top portion 142 of the piezoelectric transducer 140. The top portion 142 may be comprised of ceramic or other suitable material and the bottom 144 may be comprised of brass or bronze or other suitable non-magnetic metal. The material used for the bottom 144 must not be magnetically attractive or the magnet 120 used in the trigger 100 may interfere with the operation of the piezoelectric transducer 140. The inset 150 shown in FIG. 15 shown the detail of the thickness of the top portion 142 and bottom portion 144 of the piezoelectric transducer 140. The top portion 142 may a have a diameter of 20 mm and be 0.1 mm thick, and the bottom portion may have a diameter of 27 mm and be 0.2 mm thick. When used in a housing, the piezoelectric transducer needs to be able to bend and flex to accurately transducer the mechanical inputs into electrical signals. Buffer layers may be used to isolate the piezoelectric transducer from other elements and the surface on which the trigger 100 is placed, but still place the piezoelectric transducer 140 in physical abutment with the surface. Additionally, a potentiometer 152 may be attached to the wires 172 to enable the output of the piezoelectric transducer 140 to be more finely tuned by adding additional resistance to lower the voltage output.

The piezoelectric transducer 140 may also be any suitable trigger device or sound-receiving unit capable of translating a mechanical signal (e.g. vibration of the drumhead) into an electrical (analog or digital) sound signal. The piezoelectric transducer 140 may have the following technical specifications: plate diameter: 27 mm (1.06 inches); element diameter: 20 mm (0.787 inches); plate thickness: 0.54 mm (0.021 inches); lead length: ~50 mm (1.96 inches); plate material: brass; resonant frequency (kHz): 4.6+/−0.5 kHz; resonant impedance (ohm): 300 maximum; and capacitance (nF): 20.0+/−30% [1 kHz].

Figure 2:
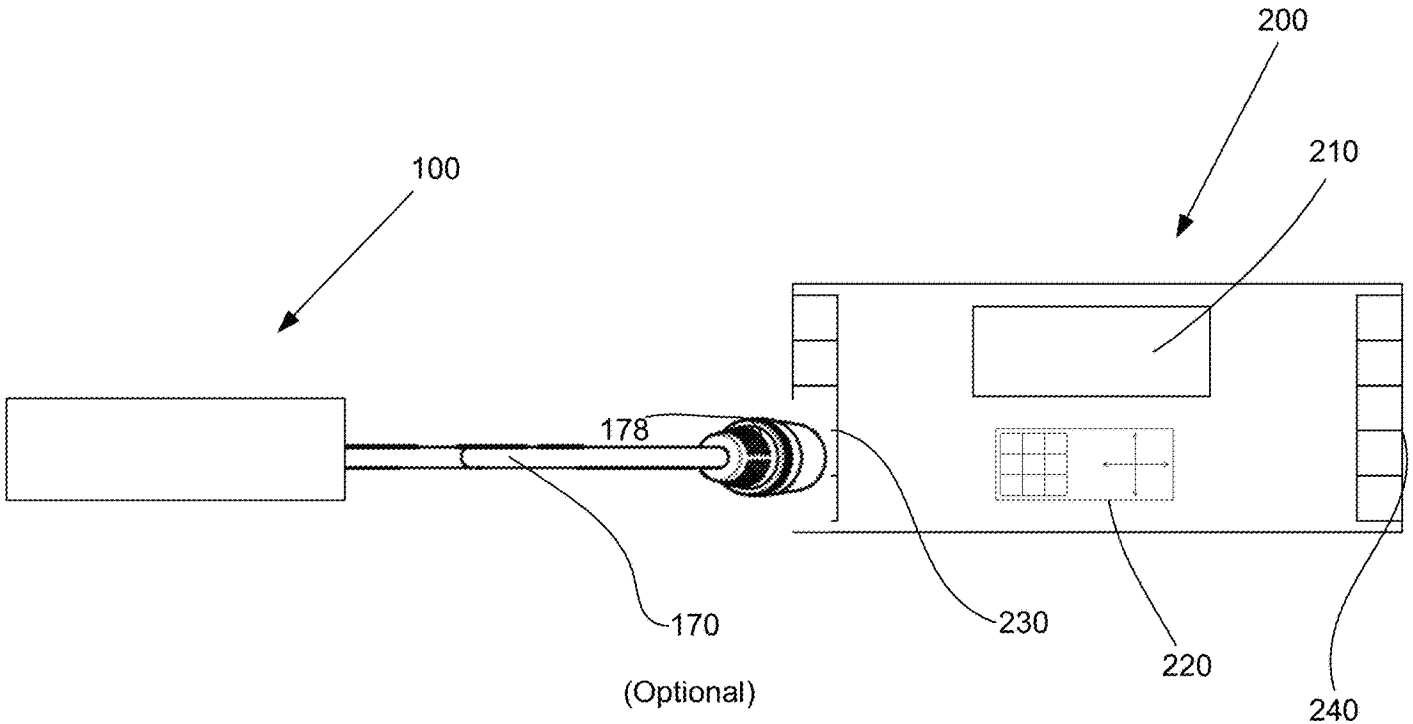
FIG. 2 provides a schematic diagram showing the trigger component connected to a sound module by an electrical lead according to the present invention.

In one embodiment, the transducer 140 may instead be a force sensing resistor ("FSR") capable of producing differing voltages as force is applied to the sensor. Many modules, such as drum module 300 shown in FIG. 2, are not capable of using the output of an FSR. Furthermore, an FSR may not produce the desired outputs with similar accuracy and responsiveness compared to a piezoelectric transducer. However, the use of an FSR instead of a piezoelectric transducer 140 may be desirable in some applications. In some embodiments, the trigger system 10 is adapted to be mounted within an enclosed space of a housing. The trigger 100 may also comprise a potentiometer or a resistor to provide an adjustment or resistance to the trigger 100 on the trigger 100 itself.

With reference now to FIG. 2, a perspective view of an exemplary musical instrument 100 according to the present invention, such as a handheld instrument, is provided. As described in greater detail hereinbelow, the instrument 100 comprises a housing, a trigger device, a battery or power source, and an output. In this embodiment of the instrument 100, shown in greater detail in FIG. 3, the housing body holds the trigger device, e.g., a piezoelectric transducer 140. The instrument 100 includes an output adapted to connect to an electrical lead 170. In the alternative, and as described below, the output may be in the form of a wireless transmitter output. In this example, the electrical lead 170 may have a tip-ring-sleeve (TRS) jack, XLR connector, or other suitable connector at the termination 178 of the electrical lead 170. The termination 170 is adapted to operatively connect to an electronic module 200, which may be a drum module or other suitable audio module or MIDI module.

The sound module 200 may have a display 210, set of controls 220, a set of inputs 230, and a set of outputs 240. The instrument 100 is adapted to connect to the module 200 by way of the electronic lead 170 to an input 230. Configuring the sound module is performed by manipulating the inputs 220 and using the display 210 to view the current configuration and options for the module 210. The module 300 may be connected to additional equipment such as speakers, computers, amplifiers, and additional electronic modules by way of outputs 240 which may comprise universal serial bus (USB) ports, TRS receptacles, XLR female receptacles, RJ-45 jacks, or other suitable connections.

In typical operation, a mechanical signal, e.g. a shaking of the instrument or a strike of the instrument housing or shell, is translated by the piezoelectric transducer 140 into an electrical signal. This electrical signal may comprise a level which may fall on a range of 127 or more levels. This signal is received by the module 200 and the module 200 determines how to interpret the signal. For example, if the instrument 100 is adapted to perform as a drum, and the signal is an electrical representation of the strike of a drum, the module 200 may determine which sound from a library of sounds to output to the outputs 240. The module 200 may also make this determination based on a set of settings used to configure the module. The set of settings may be selected from a library of configurations or settings stored in or loaded onto the module 200. The module 200 may be manipulated by the inputs 220 to fine tune the module to the particular implementation of the instrument 100. These fine tunings may be used to employ a plurality of trigger devices on a single instrument. The instrument 100 may be configured to be used with a plurality of triggers 140 to create a set of "zones" on an instrument, e.g. a drum. An isolating means or buffer zone may be created to prevent trigger cross-talk interference from other zones and triggers used on the same instrument.

Figure 3:
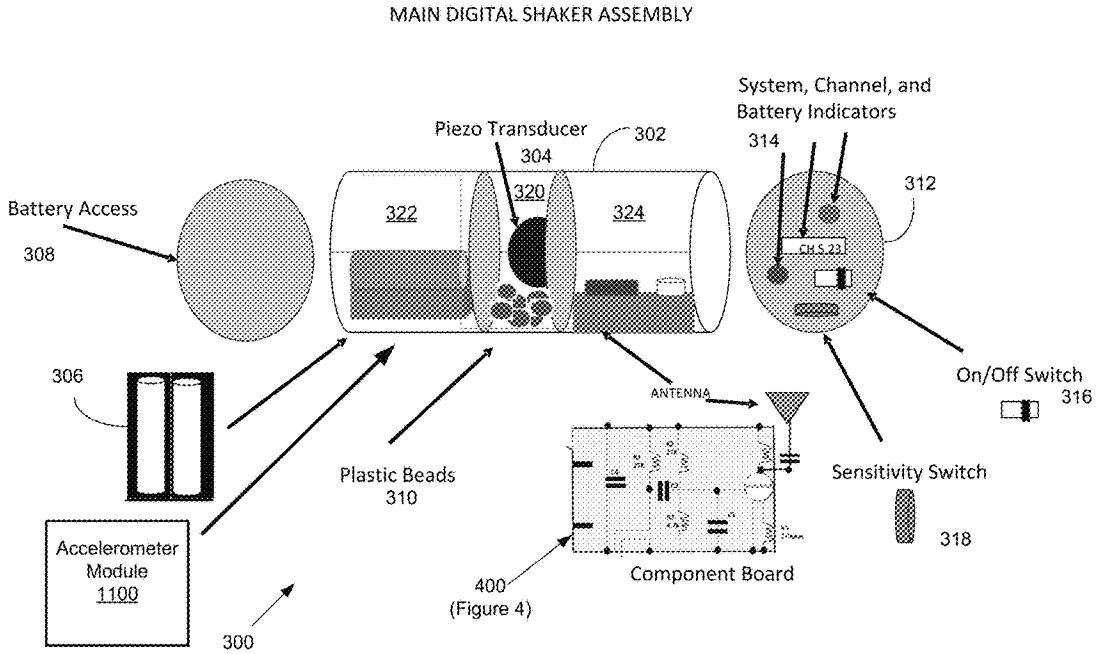
FIG. 3 provides a schematic diagram showing the components of an electrical handheld instrument including a trigger component, a wireless component and a battery power source according to the present invention.

With reference now to FIG. 3, an exemplary embodiment of an electronic handheld musical instrument 300 includes a housing 302 having a first enclosed space 320, a trigger device 304 disposed at least in part in the first enclosed space 320, a set of freely movable elements 310, such as plastic beads, also contained within the first enclosed space 320. The beads 310 are adapted to come into contact with a surface of the trigger device 304, such as a piezoelectric transducer, thereby causing it to generate a trigger signal based on a detected vibration. The trigger signal is intended to be received by a separate sound module adapted to generate signals based on the trigger signal and representing a sound output or desired sound effect or other action. In this exemplary embodiment, instrument 300 includes a power source, in this case battery 306 enclosed within a second enclosed space 322 and being accessible for removal and replacement of battery 306 by removable battery access cover 308.

Figure 4:
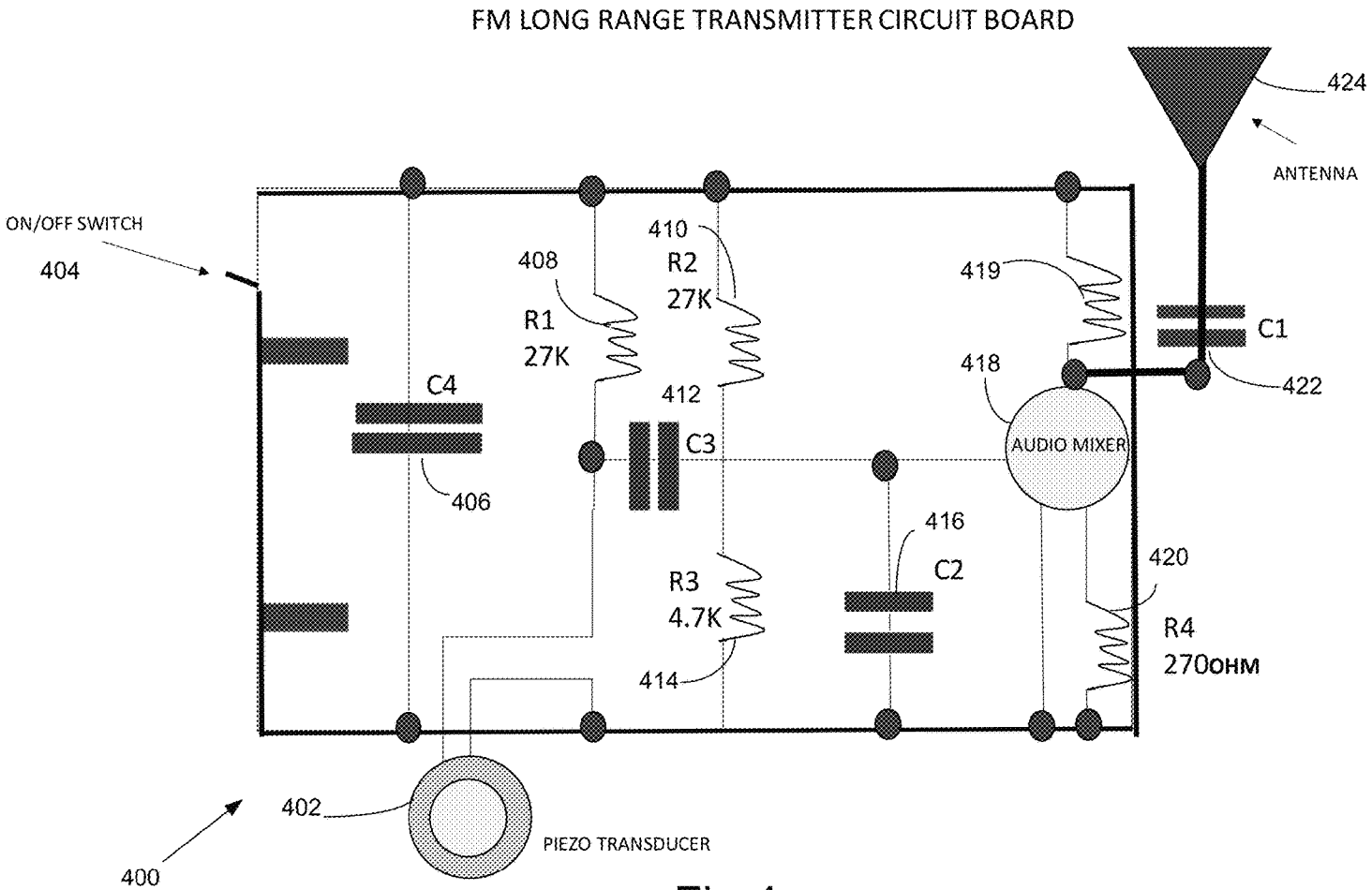
FIG. 4 is a first circuit diagram showing an FM long range transmitter wireless component connected to a trigger device in the form of a piezoelectric transducer according to the present invention.

The instrument 300 in this embodiment is a wireless device for wirelessly transmitting the trigger signal generated by trigger device 304 by way of a wireless transmitter circuit/component 400 (see FIG. 4). The wireless transmitter circuit 400 is disposed within third enclosed space 324 and accessible by removable cover 312. Cover 312 includes system, battery and channel indicators 314; an on-off switch 316 for selectively transitioning the instrument 300 from an active and inactive state and for allowing the flow of electrical current by battery 306 and the generation of trigger signal by trigger device 304. Indicators for indicating the status of the device including a mode of operation, a channel or frequency, and a battery charge indicator. The freely movable elements 310 are a set of plastic beads in this example but may be made of any material appropriate for striking contact with trigger device 304, e.g., the movable elements may be a set of metal beads. It is important the material is selected to avoid undue damage to the trigger device 304. The movable elements may be a single ball or may be a set of granular material, e.g., sand. A sensitivity switch or adjustable knob 318 may be included for user selectivity of device sensitivity.

The electronic handheld musical instrument may also comprise an accelerometer 1110 that is adapted to measure movement of the electronic handheld musical instrument along X, Y, and Z axes and output the measured movement as a movement signal. A sound bank microchip may be present on the electronic handheld musical instrument which is adapted to receive the movement signal from the accelerometer and store the movement signal in a memory. This is advantageous, as it is opposed to a sound bank microchip simply acting as a wireless tool for transmitting triggering information to a module that then stores the audio separately. Further, a radio frequency wireless transmitter may be present on the electronic handheld musical instrument, which is adapted to transmit the stored movement signal and the trigger signal, which is generated based on detected vibration from the set of freely movable elements disposed within the handheld musical instrument coming into contact with a surface of the set of trigger devices, to the separate module, potentially via an antenna. The generated signals are based on the movement signal and the trigger signal. A Bluetooth module may be implemented, which is adapted to receive a set of configuration information, potentially from a mobile device through the use of a mobile application, for the electronic handheld musical instrument. Moreover, the configuration information defines a set of operating parameters for the electronic handheld musical instrument.

With reference now to FIG. 4, the exemplary wireless transmitter 400 is shown having an input connected to a trigger device, piezoelectric transducer, 402 and having an on/off switch 404 for selectively turning the instrument on and off as desired. The wireless transmitter will include several discrete components including capacitors 406, 412, 416, and 422, resistors 408, 410, 414, 419, and 420, audio mixer 418 and an output connected to antenna 424. The wireless transmitter may be designed to have a range capability as needed for an expected condition. The antenna transmits a signal based on the trigger signal generated by trigger device, e.g., piezoelectric transducer 304, intended to be received by a sound module or an intermediate device for delivery to a sound module.

Figure 5:
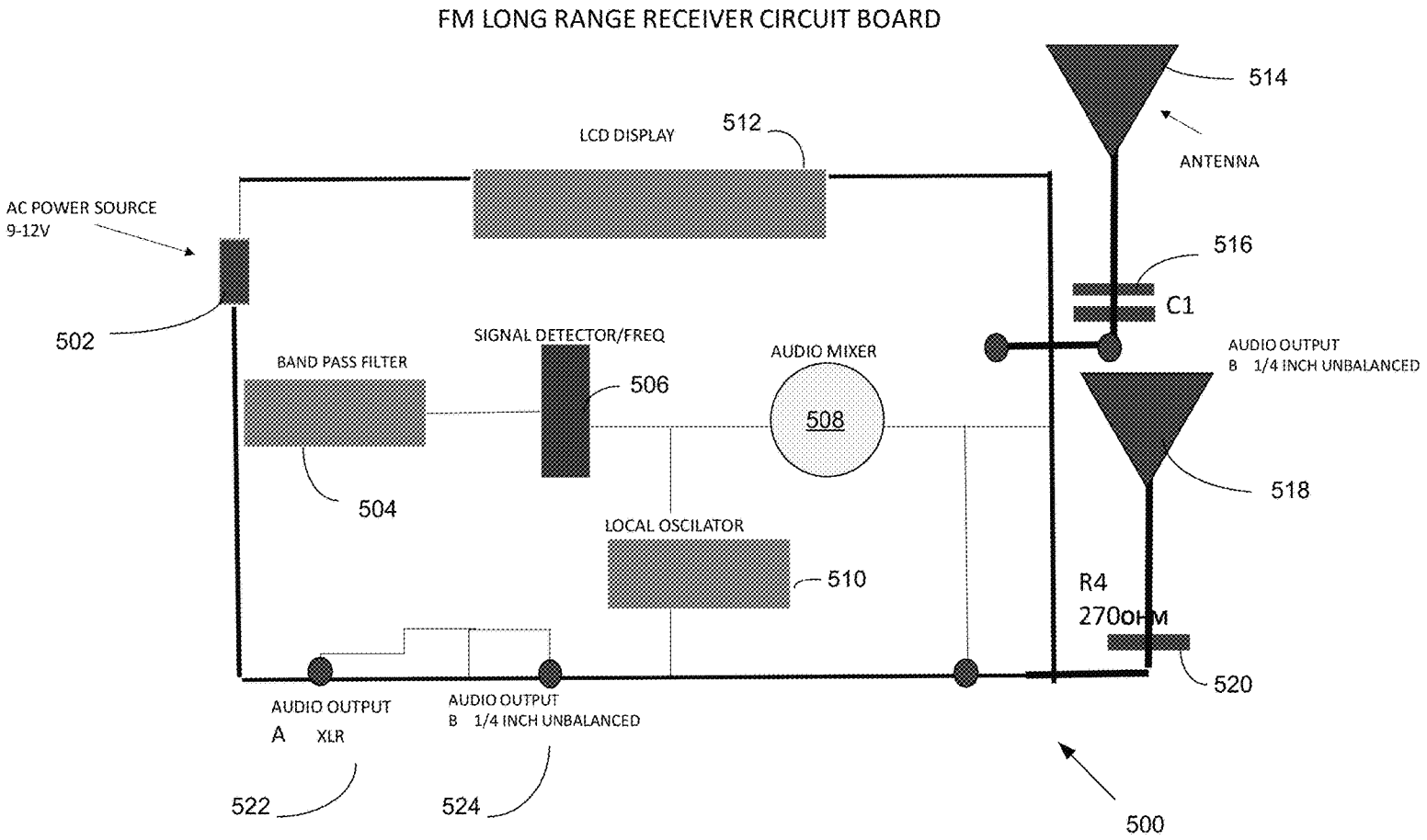
FIG. 5 is a second circuit diagram showing an FM long range receiver wireless component connected to a trigger device in the form of a piezoelectric transducer according to the present invention.

With reference now to FIG. 5, an exemplary FM long range receiver circuit 500 is shown having an AC power source (9-12 v for example) 502, a band pass filter section 504, a signal or frequency detector 506; an audio mixer 508, a local oscillator 510, an LCD display 512, an antenna 514, a capacitor 516, an audio output 518, a resistor 520 (e.g., 270 ohm), an XLR audio output 522, a ¼ inch unbalanced audio output 524. The FM long range receiver 500 receives the wireless transmission from transmitter 400 and generates an intermediate signal for delivery to a sound module or a computer input or a MIDI input or other suitable input device.

Figure 6:
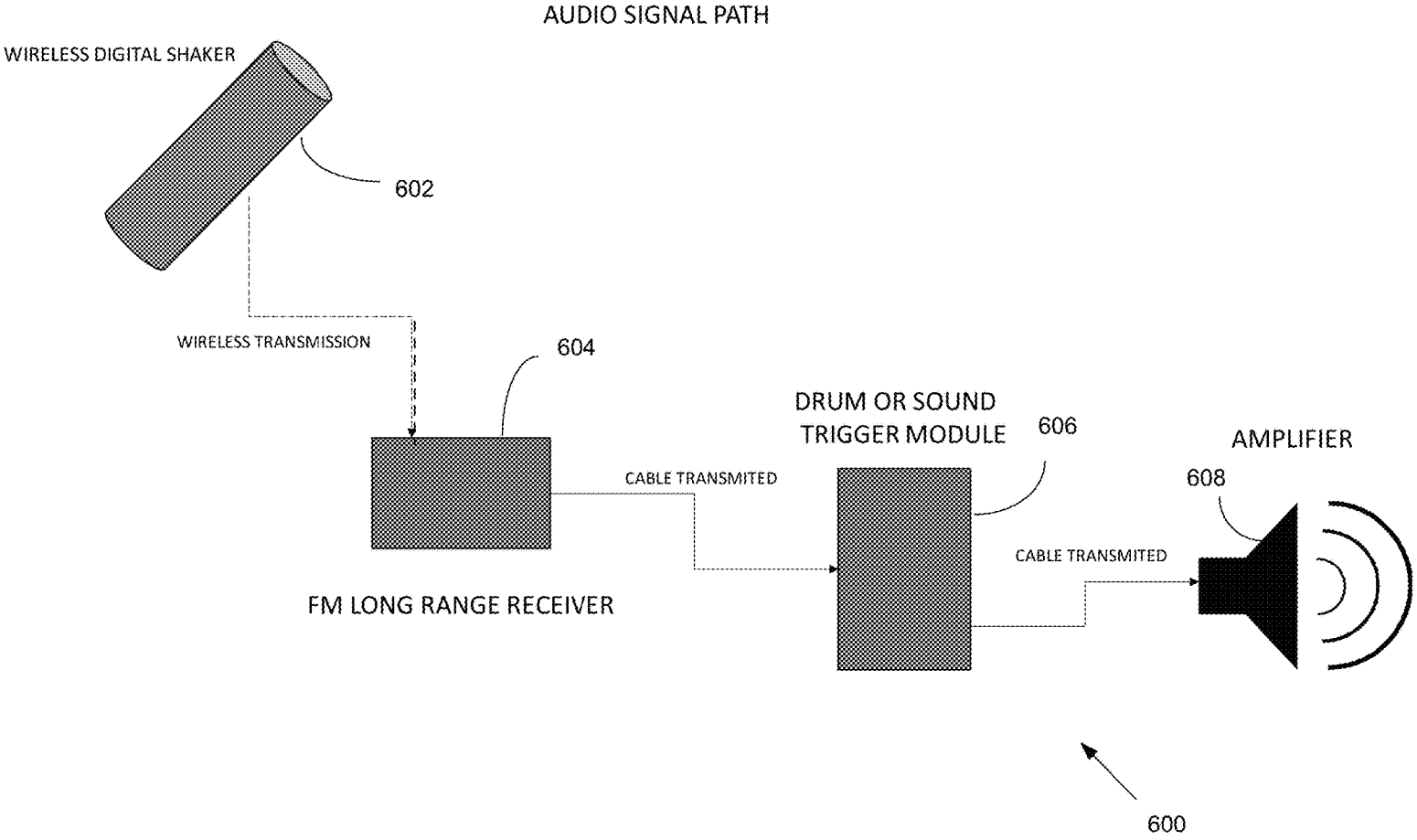
FIG. 6 is a schematic diagram showing an exemplary audio signal path according to the present invention.

With respect to FIG. 6, an exemplary audio signal path configuration 600 is shown having a wireless handheld musical instrument 602, an FM long range receiver 604, a drum or sound module 606, and an amplifier 608. The wireless handheld musical instrument 602 may be a wireless digital shaker instrument having a wireless transmitter (e.g., transmitter 400) as described hereinabove. The FM long range receiver 604 receives the signal transmitted by the wireless handheld musical instrument 602 and processes and outputs or transmits an intermediate signal. The intermediate signal may be delivered to the sound module 606 by way of a transmission cable or other suitable wired or wireless means. The sound module 606 processes the intermediate signal (or alternatively directly receives and processes the wireless instrument signal generated by the wireless transmitter) for delivery to the amplifier 608, which amplifies a sound associated with the sound signal generated by the sound module 606. The sound module may be a known module such as drum modules produced by Roland, Yamaha and others and may associate the received signal with a particular instrument profile or type (e.g., a snare, tom, kick, cymbal or other percussion instrument) and generate a sound signal based on the associated instrument profile or type for delivery to the amplifier or other means for reproducing an audible sound as desired by the musician operating instrument 602.

Figure 7:
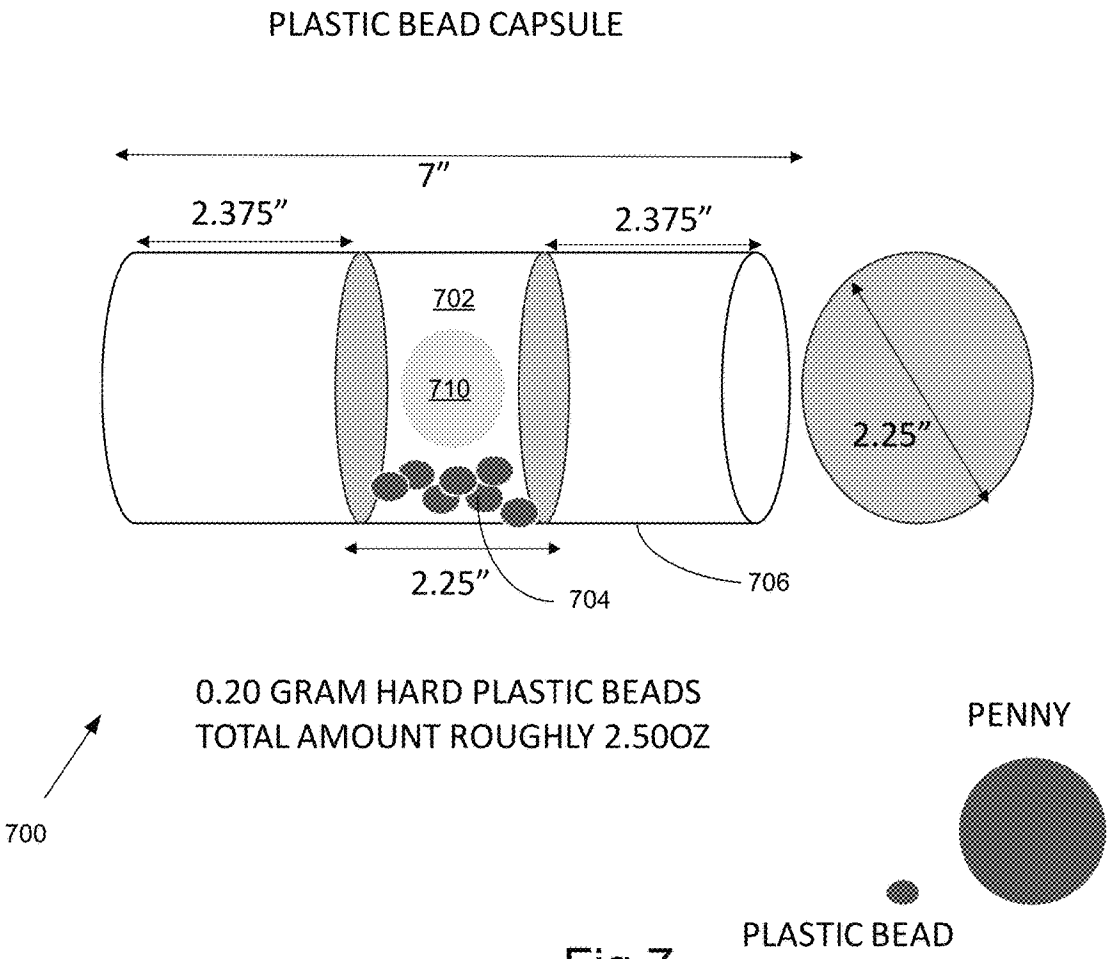
FIG. 7 is a schematic diagram showing the components of an electrical handheld instrument including a trigger component and exemplary movable elements according to the present invention.

With reference now to FIG. 7, an exemplary configuration for a handheld musical instrument 700 includes a mid-section enclosure space 702 for housing the freely moving elements 704, in this case plastic beads. Here the musical instrument 700 has a generally cylindrical housing 706 of approximately 7 inches in length and 2.25 inches in diameter with generally equal end and mid-sections. Plastic beads 704 are disposed in the mid-section 702 for striking against the piezoelectric transducer 710 also disposed in the mid-section 702. The beads 704 in one embodiment are plastic with dimensions of approximately 0.20 gram each and collectively approximately 2.5 ounces. A general size of each bead is shown in comparison to a copper penny.

Figure 8:
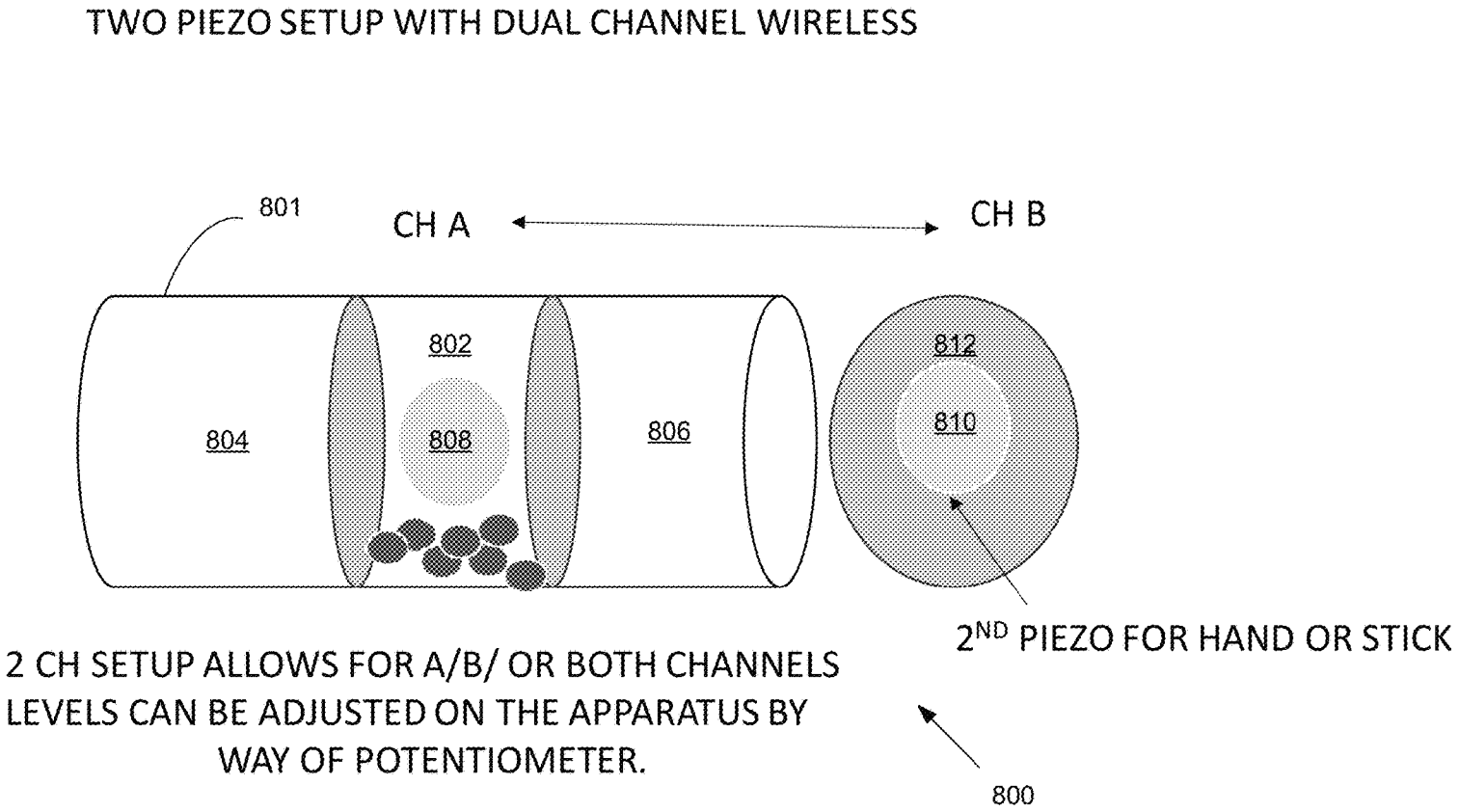
FIG. 8 is a schematic diagram showing the components of an electrical handheld instrument including a dual-trigger component and exemplary movable elements according to the present invention.

With reference now to FIG. 8, an exemplary configuration for a handheld musical instrument 800 includes a mid-section enclosure space 802 for housing the freely moving elements. Here the musical instrument has a generally cylindrical housing with two end sections 804 and 806 separated by mid-section 802. Plastic beads are disposed in the mid-section for striking against a first piezoelectric transducer 808 also disposed in the mid-section. The instrument 800 has a second piezoelectric transducer 810 disposed on one end cover 812 enclosing end section 806. The second piezoelectric transducer may be disposed to allow for a set of striking elements to be placed freely movable in end section 806 or may be arranged to sense vibrations caused by a user striking the outer surface of end cover 812 or the housing 801 generally. The output of the first and second transducers may be communicated to a sound module or other sound producing device wirelessly or wired as alternatively described herein.

Figure 9:
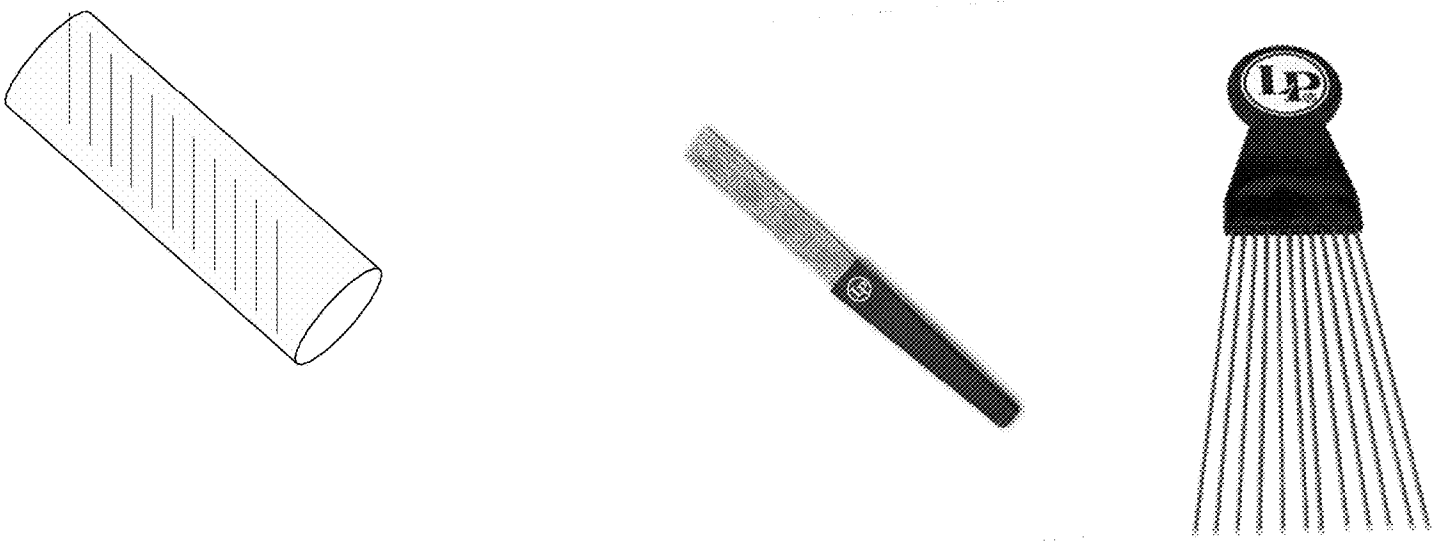
FIG. 9 illustrates additional features and striking tools in accordance with use of the present invention.

With reference now to FIG. 9, an exemplary set of additional elements are shown that may be used in playing the musical instrument in a variety of configurations and manners. A sleeve may be place on or about the instrument or as described elsewhere raised ribs or ridges may be included on the housing of the instrument to enable a desired set of sound effects. Scrapers or brushes or sticks or other striking elements may be used in connection with enjoyment of the musical instrument of the present invention.

Figure 10:
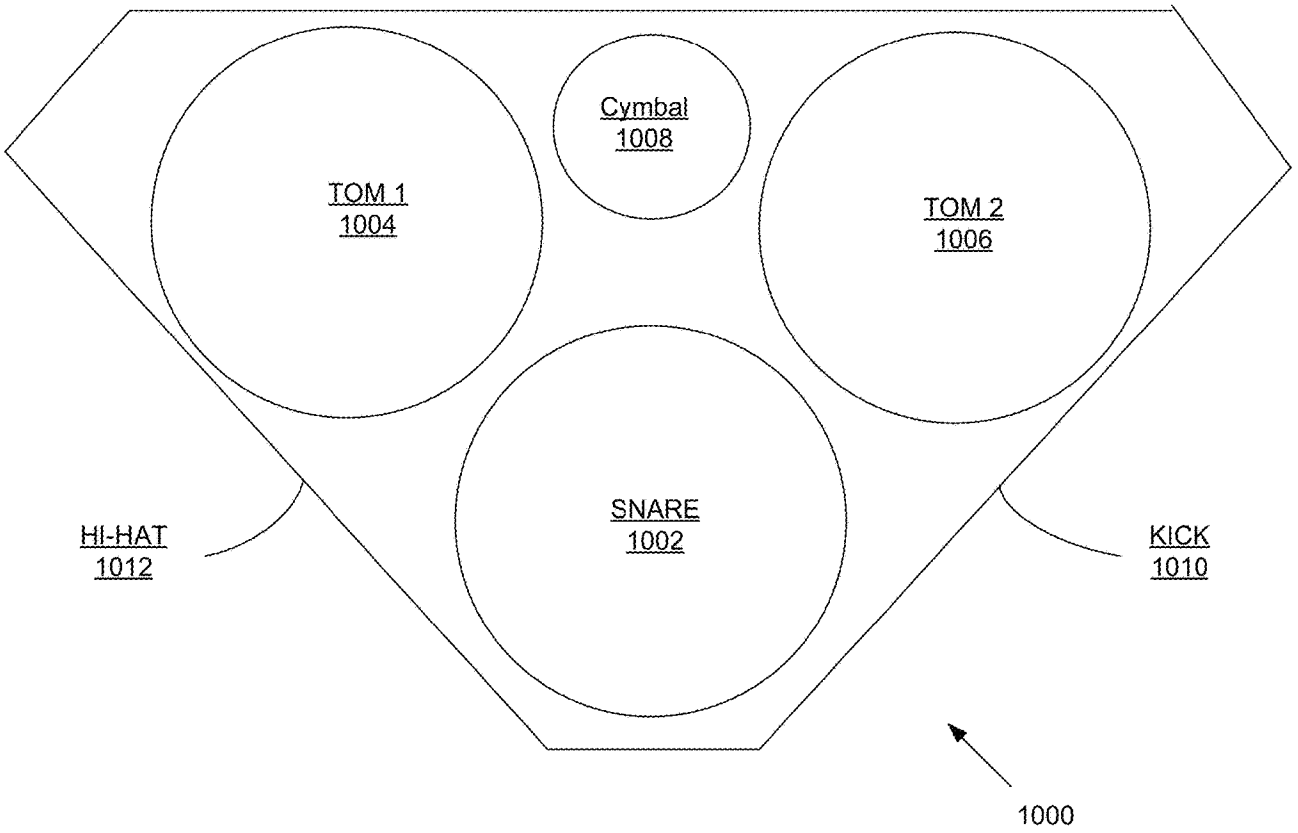
FIG. 10 is a schematic diagram of an electrical handheld instrument including a set of zones and respective trigger components according to the present invention.

With reference now to FIG. 10, a further embodiment the present invention provides a self-contained e-drum kit 1000 comprising a housing delineated by a set of discrete zones 1004-1012, each discrete zone having at least one trigger device adapted to sense vibrations caused when the zone is struck by an object. Each trigger is adapted to generate a trigger signal and includes an output for outputting the trigger signal to a transmitter or other means for electrically communicating the trigger signal to a sound processing module. In this exemplary embodiment, e-drum kit 1000 includes a zone 1002 adapted to generate a signal related to a snare drum, a zone 1004 adapted to generate a signal related to a first tom drum, a zone 1006 adapted to generate a signal related to a second tom drum, a zone 1010 adapted to generate a signal related to a kick drum, and a zone 1012 adapted to generate a signal related to a hi-hat cymbal.

Figure 11:
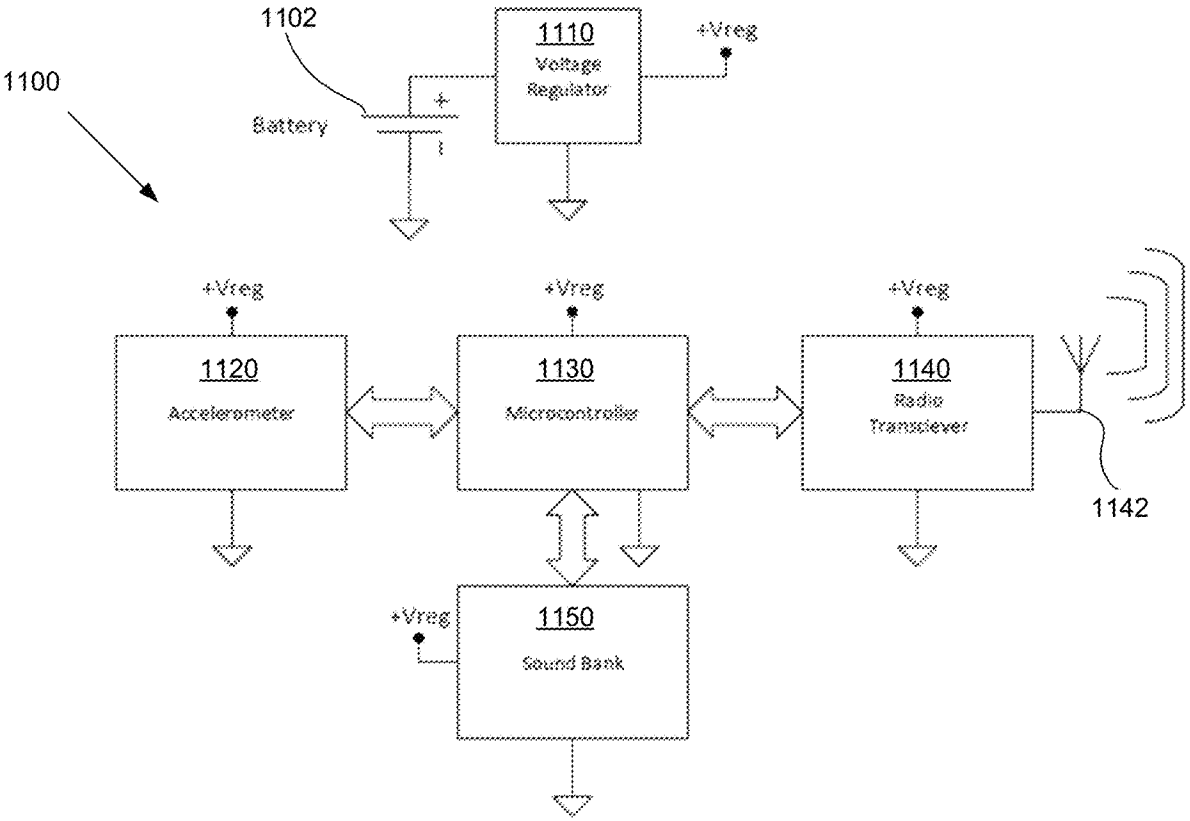
FIG. 11 illustrates an accelerometer module according to another embodiment of the present invention.

With reference now to FIG. 11, an accelerometer module 1100 according to another embodiment of the present invention is provided. The accelerometer module comprises an accelerometer 1120 adapted to adapted to measure movement of the electronic handheld musical instrument along X, Y, and Z axes and output the measured movement as a movement signal. Further, a sound bank microchip 1150 is adapted to receive movement signals from the accelerometer and stores the movement signal in a memory. This is advantageous, as it is opposed to a sound bank microchip simply acting as a wireless tool for transmitting triggering information to a module that then stores the audio separately. Further, a radio frequency wireless transmitter or transceiver 1140 is adapted to transmit the stored movement signal and the trigger signal to the separate module, potentially via an antenna 1142. The generated signals are based on the movement signal and the trigger signal. A Bluetooth module may be implemented, which is adapted to receive a set of configuration information, potentially from a mobile device through the use of a mobile application, for the electronic handheld musical instrument. The Bluetooth module may be an HC-05 type chip or module which would allow programming of the instrument via a mobile application through close proximity Bluetooth. Moreover, the configuration information defines a set of operating parameters for the electronic handheld musical instrument. In this embodiment, the instrument 300 includes a power source, in this case battery 1102 regulated by a voltage regulator 1110. A microcontroller 1130 is included as an embedded controller adapted to facilitate the transmission of the movement signal and the trigger signal. The sound associated with the trigger signal may also be amplified via an amplifier disposed within the instrument.

A further embodiment of the present invention is a user-adaptable handheld instrument having a first enclosed space with a first piezoelectric device enclosed at least in part therein and an opening provided for allowing a user to open the first enclosed space, place therein an object for striking against a surface of the piezoelectric device, and closing the first enclosed space.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. An electronic handheld musical instrument comprising:
- a housing having a first enclosed space;
- a trigger device disposed at least in part in the first enclosed space;
- a set of freely movable elements contained within the first enclosed space and adapted to contact a surface of the trigger device thereby causing the trigger device to generate a trigger signal based on a detected vibration;
- wherein the trigger signal is transmitted to a separate module, the separate module adapted to generate output signals based on the trigger signal; and
- wherein the output signals represent one of a sound output, desired sound effect, lighting effect, audio output, or switching signal.

2. The electronic handheld musical instrument of claim 1, wherein the trigger device is a piezoelectric transducer.

3. The electronic handheld musical instrument of claim 1, further comprising:
- a wireless device for wirelessly transmitting the trigger signal;
- an on-off switch for selectively transitioning the handheld musical instrument from an active and inactive state and for allowing the flow of electrical current and the generation of trigger signal; and
- indicators for indicating the status of the device including a mode of operation.

4. The electronic handheld musical instrument of claim 1, wherein the set of freely movable elements comprise a set of plastic beads, a set of metal beads, a ball, or a set of granular material.

5. The electronic handheld musical instrument of claim 1, wherein the housing further comprises a movable portion adapted to provide access to the interior of the first enclosed space for placing or removing the set of freely movable elements.

6. The electronic handheld musical instrument of claim 1, wherein the housing further comprises a second enclosed space and a second trigger device.

7. The electronic handheld musical instrument of claim 1, further comprising one or more of a sensitivity element for user selection of sensitivity setting, a battery power source, and a battery level indicator.

8. The electronic handheld musical instrument of claim 7, wherein the housing further comprises a battery enclosure space for receiving the battery power source.

9. The electronic handheld musical instrument of claim 1, wherein the housing further comprises a wireless device enclosed space for receiving a wireless transmitting device.

10. The electronic handheld musical instrument of claim 1, further comprising a channel selector switch adapted to selectively place the handheld musical instrument in operation over a given channel or frequency.

11. The electronic handheld musical instrument of claim 1, further comprising:
- an audio mixer;
- an antenna for transmitting the trigger signal;
- a band pass filter section;
- a signal detector;
- a local oscillator;
- an XLR audio output; and
- a ¼ inch unbalanced audio output.

12. The electronic handheld musical instrument of claim 3, wherein the separate module further comprises an FM long range receiver for receiving the wirelessly transmitted trigger signal, and wherein the separate module is further adapted to generate an intermediate signal for delivery to a sound module.

13. The electronic handheld musical instrument of claim 1, further comprising an amplifier for amplifying a sound associated with the trigger signal.

14. The electronic handheld musical instrument of claim 1, further comprising:
- an opening adapted to provide access to the first enclosed space, the opening further adapted to receive an object for striking against the surface of the trigger device; and
- an opening cover adapted to close the first enclosed space.

15. The electronic handheld musical instrument of claim 1, further comprising:
- an accelerometer adapted to observe movement of the electronic handheld musical instrument along X, Y, and Z axes and output a movement signal based on the observed movement;
- a sound bank microchip adapted to receive the movement signal from the accelerometer and store the movement signal in a memory;
- a radio frequency wireless transmitter adapted to transmit one or both of the stored movement signal and the trigger signal to the separate module; and
- wherein the generated signals are based on one or both of the movement signal and the trigger signal.

16. The electronic handheld musical instrument of claim 1, further comprising a Bluetooth module adapted to receive a set of configuration information for the electronic handheld musical instrument, the set of configuration information having been transmitted by a mobile device, and the configuration information defining a set of operating parameters for the electronic handheld musical instrument.

17. A method for generating electronic signals from an electronic handheld musical instrument for processing by a module to produce sounds adapted to replicate non-electronic traditional handheld instruments, the method comprising:

actuating a trigger device disposed within the electronic handheld musical instrument by manipulating the electronic handheld musical instrument, the manipulation causing a set of freely movable elements disposed within the handheld musical instrument to contact a surface of the trigger device thereby causing the trigger device to generate a trigger signal based on a detected vibration;

transmitting the trigger signal to a separate module; and generating, by the separate module, output signals based on the trigger signal, the output signals representing one of a sound output, desired sound effect, lighting effect, audio output, or switching signal.

18. The method of claim 17, wherein the trigger device comprises a piezoelectric transducer, and wherein the movable elements are one from the group consisting of a set of plastic beads; a set of metal beads; a ball; and a set of granular material.

19. The method of claim 17, further comprising:

measuring by an accelerometer movement of the electronic handheld musical instrument along X, Y, and Z axes;

outputting by the accelerometer the measured movement as a movement signal;

receiving and storing by a sound bank microchip the movement signal from the accelerometer; and transmitting by a radio frequency wireless transmitter the stored movement signal and the trigger signal to the separate module, and wherein the generated signals are based on the movement signal and the trigger signal.

20. The method of claim 17, further comprising amplifying a sound associated with the trigger signal via an amplifier disposed within the electronic handheld musical instrument.

* * * * *